US007351052B2

(12) United States Patent
Chun et al.

(10) Patent No.: US 7,351,052 B2
(45) Date of Patent: Apr. 1, 2008

(54) APPARATUS FOR PRODUCING NANOFIBER UTILIZING ELECTOSPINNING AND NOZZLE PACK FOR THE APPARATUS

(75) Inventors: Suk-Won Chun, Seoul (KR); Jong-Su Park, Seoul (KR)

(73) Assignee: Nanophil Co., Ltd. (KR)

( * ) Notice: Subject to any disclaimer, the term of this patent is extended or adjusted under 35 U.S.C. 154(b) by 315 days.

(21) Appl. No.: 10/523,141

(22) PCT Filed: Jul. 16, 2003

(86) PCT No.: PCT/KR03/01403

§ 371 (c)(1),
(2), (4) Date: Jan. 31, 2005

(87) PCT Pub. No.: WO2004/016839

PCT Pub. Date: Feb. 26, 2004

(65) Prior Publication Data

US 2005/0233021 A1 Oct. 20, 2005

(30) Foreign Application Priority Data

Aug. 16, 2002 (KR) ..... 10-2002-0048594

(51) Int. Cl.
*B29C 35/08* (2006.01)

(52) U.S. Cl. ..... 425/174.8 R; 425/378.2; 425/382.2; 425/DIG. 217; 425/174.8 E; 425/83.1; 425/72.2

(58) Field of Classification Search ..... 425/378.2, 425/464, 83.1, 174.8 R, DIG. 217, 174.8 E, 425/72.2, 382.2; 264/441
See application file for complete search history.

(56) References Cited

U.S. PATENT DOCUMENTS

| | | | | |
|---|---|---|---|---|
| 5,227,172 | A | 7/1993 | Deeds | 425/72.2 |
| 5,435,708 | A * | 7/1995 | Kaun | 425/72.2 |
| 6,183,684 | B1 * | 2/2001 | Lu | 264/555 |
| 6,308,509 | B1 | 10/2001 | Scardino et al. | 57/402 |
| 6,604,928 | B1 * | 8/2003 | Wnuk et al. | 425/198 |
| 6,709,623 | B2 * | 3/2004 | Haynes et al. | 264/465 |
| 6,991,702 | B2 * | 1/2006 | Kim | 156/379.6 |
| 7,018,188 | B2 * | 3/2006 | James et al. | 425/72.2 |
| 2002/0089094 | A1 * | 7/2002 | Kleinmeyer et al. | 264/465 |
| 2002/0122840 | A1 * | 9/2002 | Lee et al. | 425/174.6 |

FOREIGN PATENT DOCUMENTS

| | | | |
|---|---|---|---|
| JP | 1991-161502 | A | 7/1991 |
| KR | 2002-0093178 | A | 12/2002 |

* cited by examiner

*Primary Examiner*—Robert B. Davis
*Assistant Examiner*—Maria Veronica Ewald
(74) *Attorney, Agent, or Firm*—Peter F. Corless; Edwards Angell Palmer & Dodge LLP

(57) ABSTRACT

The apparatus for producing a nanofiber includes a supply unit (110) for supplying melted polymer for fiber material, a spinning unit (122) having several radiation nozzles (122) to which first voltage having a polar is applied to discharge the polymer solution supplied from the supply unit in a filament form, a collector (130) spaced apart form the spinning nozzles in order to pile the filament from the spinning unit and applied to second voltage having opposite polar to the first voltage, and a control unit (140) applied to the first voltage having the same polar as the charged filament and extended from an end of the spinning nozzle toward the collector at least at both sides of the spinning unit in order to prevent repulsion and dispersion of the filament stream radiated from each spinning nozzle.

19 Claims, 8 Drawing Sheets

APPARATUS FOR PRODUCING NANOFIBER UTILIZING ELECTOSPINNING AND NOZZLE PACK FOR THE APPARATUS

TECHNICAL FIELD

The present invention relates to an apparatus for producing nanofiber and a nozzle pack for the apparatus, and more particularly to an apparatus for producing nanofiber utilizing electrospinning and a nozzle pack for the apparatus.

BACKGROUND ART

In general, the electrospinning is used to produce fibers having a diameter of several nanometers by using various kinds of polymers, i.e., polymer melt, polymer solution, etc.

A nanofiber gives various physical properties, since the fiber shows a very high area-to-volumn ratio in comparison with the conventional fiber. A web composed of these nanofibers is a material of porous membrane, which is useful in various fields such as various filters, a dressing for medical treatment and an artificial support.

In the conventional electrospinning, a fiber is manufactured by discharging solution less than several grams per second from one or a small number of nozzles, which is not economical due to the slow producing rate.

U.S. Pat No. 4,323,525 discloses a technique related to the electrospinning, in which a tubular product is made by electrostatically spinning a fiber-forming solution on a rotating mandrel charged at −50 kV by three grounded syringes. However, this technique is not suitable for manufacturing many nanofibers because of the restriction of a shape and number of the spinning nozzles being adapted. In addition, since the technique is limited to manufacturing tubular products, it is difficult to continuously manufacture multipurpose planar webs.

Until now, various electrospinning nozzles have been suggested in the following documents: a syringe needle [J. M. Deitzel, J. D. Kleinmeyer, D. Harris, N. C. Beck Tan, Polymer 42, 261-272 (2001)]/[J. M. Deitzel, J. D. Kleinmeyer, J. K. Hirvonen, N. C. Beck Tan, Polymer 42, 8163-8170(2001)], a capillary metal tube [Y. M. Shin, M. M. Hohman, M. P. Brenner, G. C. Rutledge, Polymer 42, 9955-9967(2001)], a capillary glass [J. Doshi, D. H. Reneker, Journal of Electrostatics 35, 151-160(1995)], etc.

As described above, the problem caused by a small number of the spinning nozzles can be overcame by using many nozzles. However, using many nozzles causes the discharge of solvent to be not easy and makes the stream of solution be irregular due to the repulsion between charged filaments.

On the other hand, Korean Laid-open Pat. Publication No.2002-0051066 discloses "Apparatus for producing a polymer web", which includes a base having an inlet pipe for allowing melted polymer materials to pass through, a base conductor board attached on the lower surface of the base for transferring electric charges, at lease one nozzle mounted to nozzle taps formed on the base conductor board for discharging the polymer material, a charge distribution board mounted to a lower portion of the base conductor board, and a conductor board mounted to a lower portion of the charge distribution board.

Since all conductor boards for transferring electric charges are exposed and a separate conductor board is located between the base conductor board and the collector, this apparatus disadvantageously forms too strong and unnecessary electric fields between the spinning part and the collector, causing the discharge of solution not regular when many spinning nozzles are configured.

In addition, the strong electric field causes formation of agglomeration at ends of some spinning nozzles when the solution is discharged, thereby resulting that webs unclear or having irregular diameters are manufactured.

On the other hand, if the apparatus is composed of multiple nozzles, the stream of solution deviates from its path due to the repulsion between the filaments discharged with the same polarity, so the stream may not be appropriately induced to a correct location on the collector.

DISCLOSURE OF INVENTION

The present invention is designed to overcome such problems of the prior art. Therefore, an object of the invention is to provide an improved apparatus for producing nanofibers utilizing the electrospinning, which may prevent charged filament stream from deviating from its path when being discharged.

Another object of the present invention is to provide a spinning nozzle pack capable of stably discharging the charged solution.

In order to accomplish the above object, the present invention provides an apparatus for producing nanofiber utilizing electrospinning, which includes a supply unit for supplying polymer materials of the liquid state used to produce fibers, a spinning unit having a plurality of spinning nozzles for discharging the polymer materials supplied by the supply unit in a charged filament form, a collector installed below the spinning unit for piling the charged filament discharged by the spinning unit in a specific thickness, and a control unit being charged to have a voltage of same polarity as one of the charged filament and located between the spinning unit and the collector for guiding the stream of the charged filament in order to prevent repulsion and dispersion of the charged filaments discharged from each spinning nozzle.

In addition, the apparatus may further include an induction unit positioned between the control unit and the collector to surround the filament stream and charged at a voltage of same polarity as the control unit for inducing the charged filament stream passing through the control unit toward the collector.

In another aspect of the present invention, there is provided a spinning nozzle pack including a body having a supplier for supplying the solution and a receiver for receiving the supplied solution, an electric connector mounted on the body to be sunk in the solution for charging the solution when voltage is supplied thereto, and a plurality of spinning nozzles having capillary tube for discharging the solution charged by the electric connector in a fine filament form.

BRIEF DESCRIPTION OF THE DRAWINGS

These and other features, aspects, and advantages of preferred embodiments of the present invention will be more fully described in the following detailed description, taken accompanying drawings. In the drawings.

BEST MODES FOR CARRYING OUT THE INVENTION

Hereinafter, preferred embodiments of the present invention will be described in detail with reference to the accompanying drawings.

Figure 1:
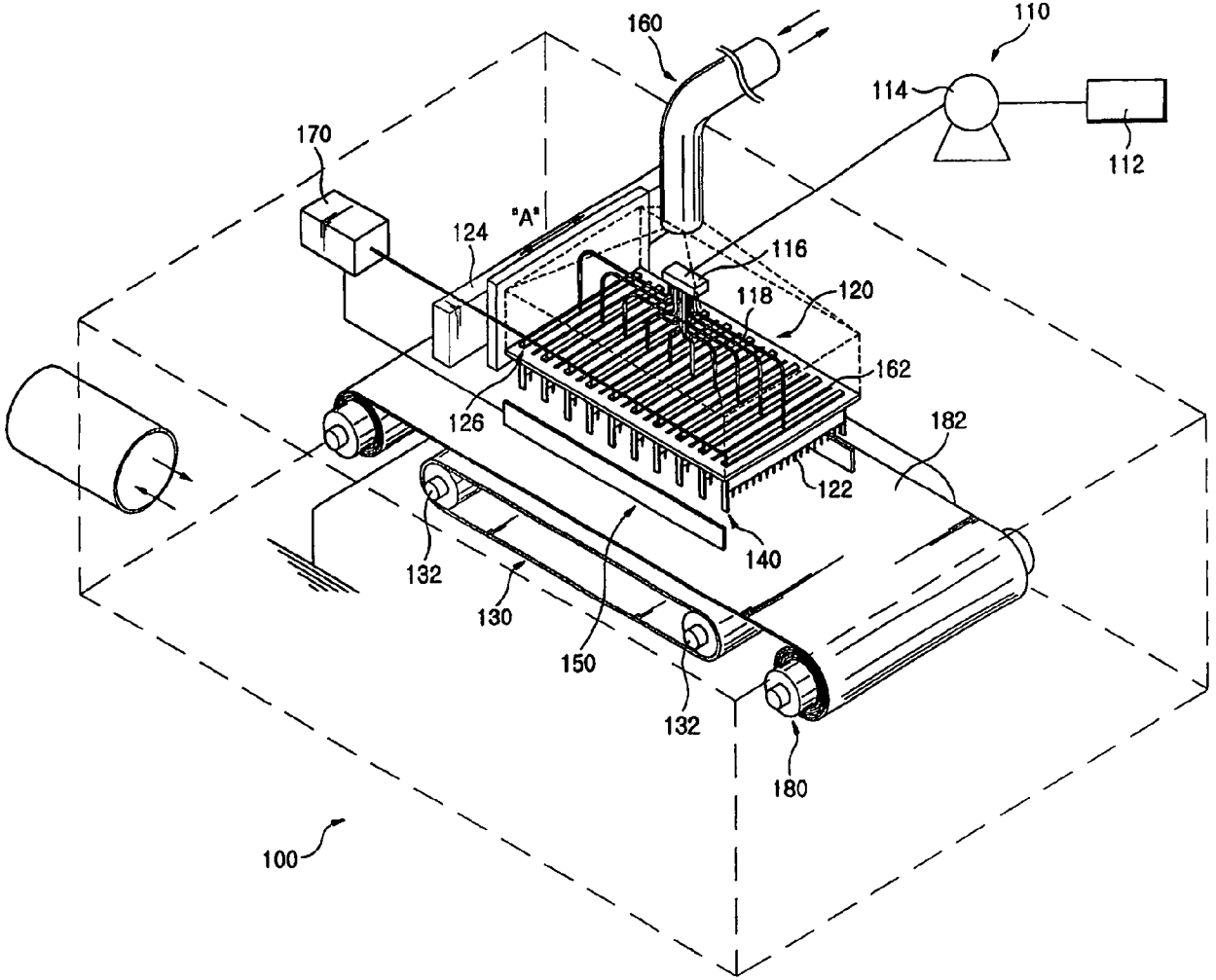
FIG. 1 is a perspective view showing an apparatus for producing nanofibers utilizing the electrospinning according to one preferred embodiment of the present invention.
Figure 2:
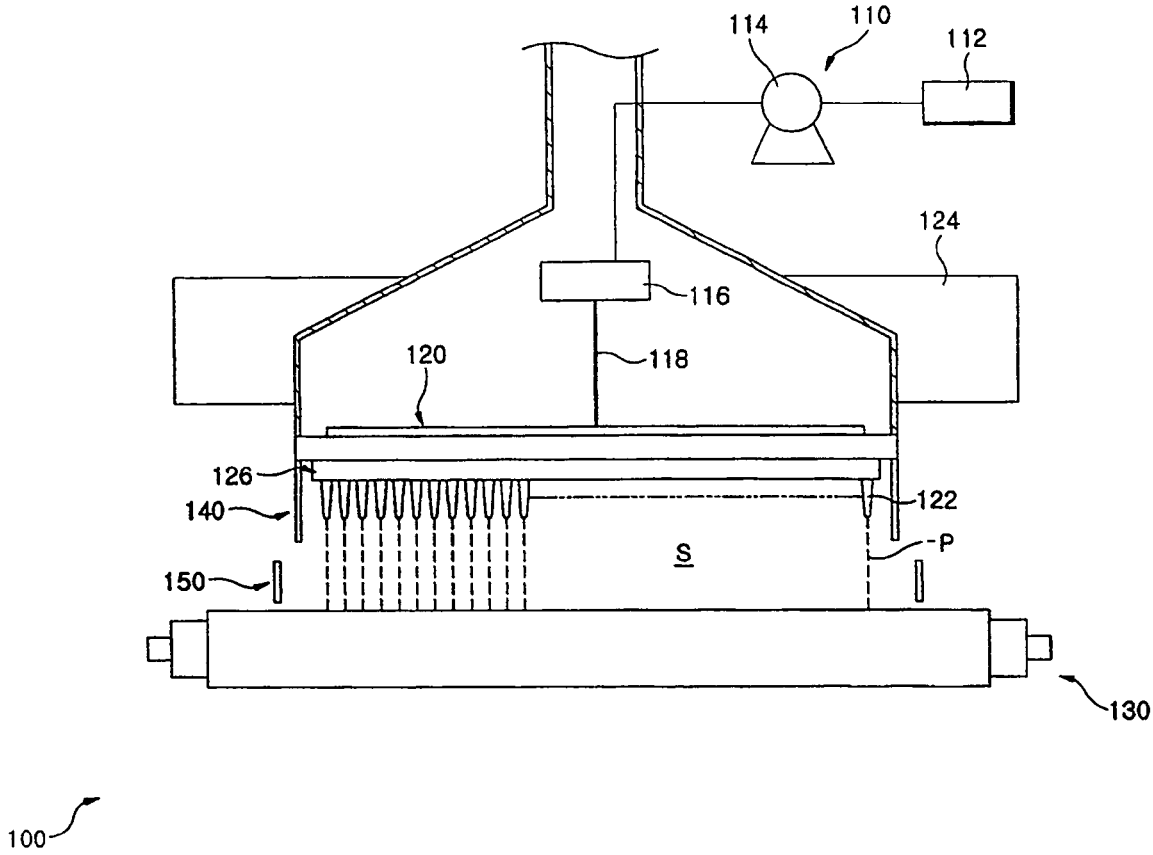
FIG. 2 is a sectional view showing the apparatus of FIG. 1.

FIG. 1 and FIG. 2 are perspective view and sectional view respectively showing an apparatus for producing nanofibers utilizing the electrospinning according to one preferred embodiment of the present invention.

Referring to FIG. 1 and FIG. 2, the apparatus for producing nanofibers 100 according to one preferred embodiment of the present invention includes a supply unit 110 for supplying melted polymer materials used for making fiber, a spinning unit 120 having a plurality of spinning nozzles 122 for discharging the polymer materials supplied by the supply unit 110 in a charged filament form, a collector 130 spaced apart from the spinning nozzles 122 so as to pile the charged filament discharged by the spinning unit 120 in a specific thickness, control units 140 installed at least at both sides of the spinning unit 120, an induction unit 150 positioned between the control unit 140 and the collector 130 to surround the filament stream (S), and an air conditioning unit 160 for injecting air into the space between the spinning unit 120 and the collector 130 and evaporating solvent in this space so that the solvent is ejected outside.

As shown in FIG. 1 and FIG. 2, the supply unit 110 includes a storage container 112 for storing the solution in which polymer material used for making fibers are dissolved, a pump 114 for pressing the solution stored in the storage container 112 so as to be supplied to the spinning unit 120 by a fixed quantity, and a distributor 116 for distributing the solution to each nozzle.

The storage container 112 contains polymer solution or melted polymer material. In this case, the polymer material may adopt all kinds of polymer materials soluble in the solvent such as poly vinylidene fluoride (PVDF), polyacrylonitile (PAN), polysulfone (PS), polyimide (PI) and polyethylene oxide (PEO). On the other hand, a variety of polymer materials may be mixed in one storage container or each polymer material may independently stored in each storage container 112. Hence, it is possible to use many storage containers 112, if necessary.

The pump 114 may control a spinning speed of the spinning unit 120 by controlling its output.

The distributor 116 is installed between the supply unit 110 and the spinning unit 120, and distributes the solution transferred from the pump 114 to each spinning nozzle 122 via a transfer line 118 by a fixed quantity.

On the other hand, the present invention is not restricted in the above-mentioned structure, but may be modified so that may supply units 110 are independently linked to each spinning nozzle in order to supply solution by more fixed quantity, of course.

The spinning unit 120 includes a plurality of spinning nozzles 122 applied to a specific positive (+) voltage or grounded. The spinning unit 120 is preferably reciprocated at a specific speed in a direction of the arrow "A" in FIG. 1 above the collector 130 by means of the transfer mount 124. The spinning unit 120 is used for spinning the charged fiber-forming solution supplied from the supply unit 110 toward the collector 130 in a shape of fine filament.

The positive (+) voltage is excited by output voltage of a high-voltage unit 170. The high-voltage unit 170 outputs direct current voltage in the range of 10 kV~120 kV.

The spinning unit 120 includes at least one spinning nozzle pack 126 in which a plurality of spinning nozzles 122 are arranged in series. The number of the spinning nozzles 122 composing the spinning packs 126 or the number of the spinning nozzle packs 126 composing the spinning unit 120 is determined by synthetically considering size, thickness and production speed of webs to be produced. For example, it is desirable that each spinning nozzle pack 126 has more than 10 spinning nozzles 122 in case of manufacturing webs having thickness of 10~100 μm and width of 5~100 cm at a speed of 1 m per minute, it is desirable that more than 10 spinning nozzles 122 are configured in each spinning nozzle pack 126, and 1~50 rows of the spinning nozzle packs 126 are arranged on the transfer mount 124. More preferably, the number of the spinning nozzle pack 126 is in the range of 1~20. FIG. 1 shows that ten spinning nozzle packs are arranged at predetermined intervals, as an example.

In addition, when considering prevention of electric field interference, prevention of contact between discharging streams, and an available space of the spinning nozzles, it is desirable to arrange the spinning nozzles 122 mounted in the spinning nozzle pack 126 at intervals of 2~50 mm, more preferably 3~30 mm. Here, an interval between the spinning packs 126 is preferably in the range of 3~30 mm, more preferably 20~150 mm.

Figure 3:
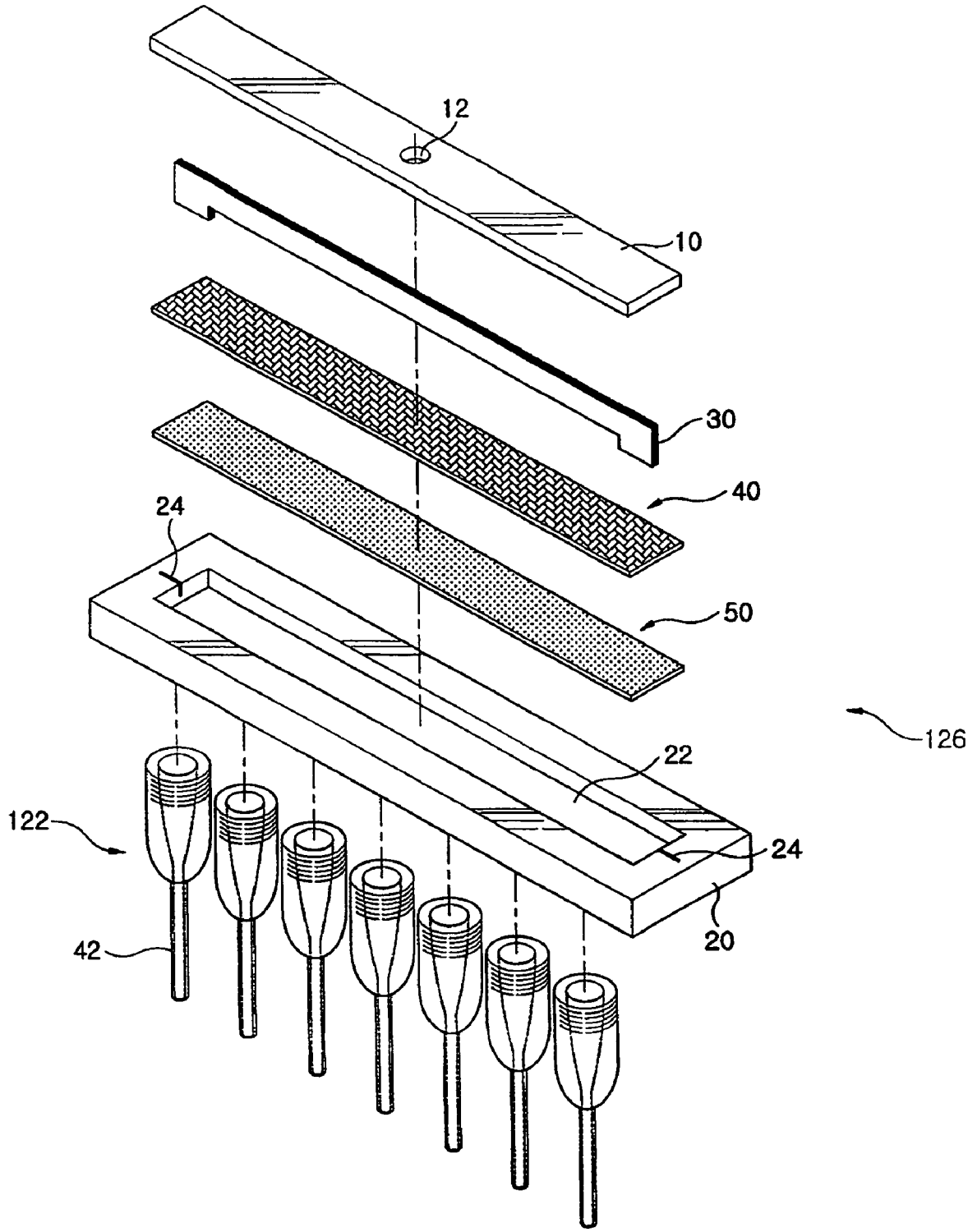
FIG. 3 is an exploded perspective view showing a spinning nozzle pack shown in FIG. 1 and FIG. 2.

FIG. 3 is an exploded perspective view of the spinning nozzle pack 126 shown in FIG. 1 and FIG. 2.

Referring to FIG. 3, the spinning nozzle pack 126 includes a cover 10 having a supplier 12 to which the solution used as fiber material is supplied, a body 20 having a receiving portion 22 capable of receiving the supplied solution, an electric connector 30 mounted to the body 20 to be sunk in the solution for charging the solution when the voltage is applied thereto, a plurality of spinning nozzles 122 each of which has a capillary tube 42 for discharging the solution charged by the electric connector 30 in a fine filament form, a filter 40 installed below the electric connector 30, and a distribution board 50 located below the filter 40.

The spinning nozzle pack 126 shown in FIG. 3 may be adapted not only to the apparatus for producing nanofibers according to a preferred embodiment of the present invention, but also to an apparatus for producing nanofibers utilizing the usual electrospinning.

The body 20 is made of engineering plastic belonging to polyetheretherketon, fluorine series or polyamide series. In the body 20, the receiver 22 is prepared for receiving the solution. Slots 24 are formed on both sides of the receiver 22 in a longitudinal direction. Both ends of the electric connector 30 are inserted into the slots 24. An open end of the receiver 22 of the body 20 is combined with the cover 10 in which the supplier 12 connected with the transfer line 118 is provided. The supplier 12 transfers the solution supplied from the supply unit 110 to the receiver 22.

The electric connector 30 is installed to sink into the solution in the body 20. Voltages are applied to the electric connector 30 by output of the high-voltage unit 170, and the solution is charged by the applied voltage. The applied voltage and polarity are same as described above.

The electric connector 30 is made in a shape of a conductorboard or a conductor stick of a specific length along a longitudinal direction of the body 20, and does not have a sharp portion in order to prevent concentration of the electric field.

Figure 4:
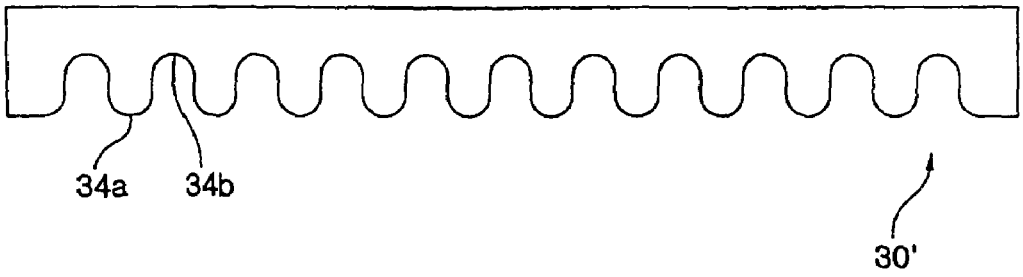
FIG. 4 is a front view showing a modification of an electric connector of the spinning nozzle pack shown in FIG. 3.

FIG. 4 is a front view showing a modification of the electric connector of FIG. 3.

Referring to FIG. 4, the electric connector 30' according to this embodiment has valleys 34*b* and ridges 34*a*, which are periodically formed at its lower portion horizontally. In the electric connector 30', each ridge 34*a* is mounted on the body 20 to be in correspondence with the entrance of the spinning nozzle 122, namely, the center of each ridge 34*a* is fit on the center of the spinning nozzle 122.

As shown in FIG. 3, the filter 40 is located below the electric connector 30 and inserted into the receiver 22 of the body 20. The filter 40 is used for removing a gelation particle and waste materials in the charged solution.

The distribution board 50 is installed in the body 20 so as to be positioned below the filter 40, and acts for uniformly distributing the charged solution through each spinning nozzle 122. It is desirable that the distribution board 50 adopts a porous metal board or porous plastic board having a plurality of holes of diameter from 0.5 to 3 mm.

Figure 5:
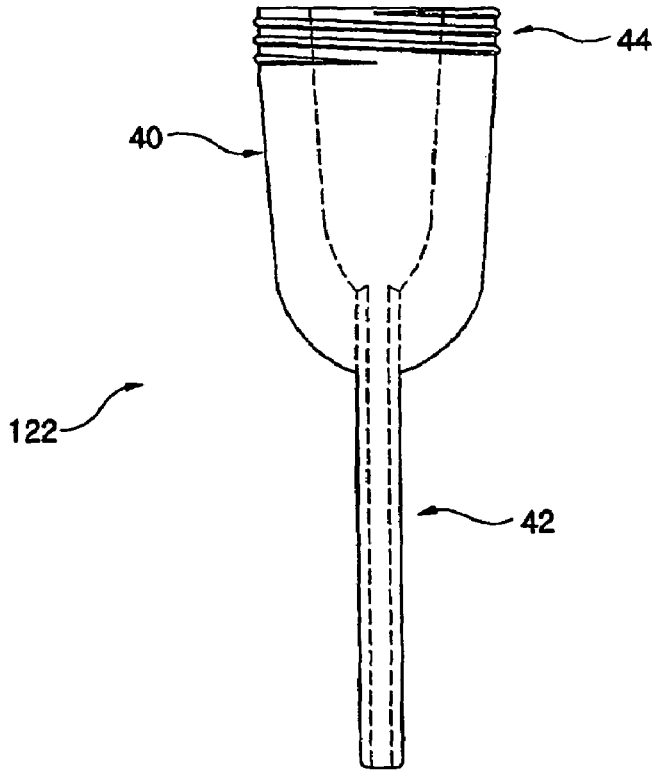
FIG. 5 is a perspective view showing the shape of the spinning nozzle shown in FIG. 3.
Figure 6:
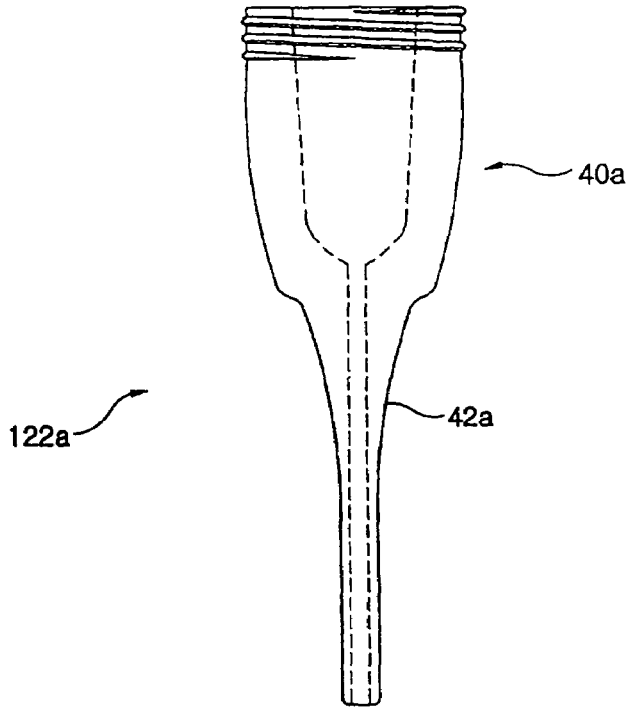
FIG. 6 is a perspective view showing a modification of the spinning nozzle of FIG. 5.

As shown in FIG. 5, each spinning nozzle 122 includes a nozzle body 40 for receiving a solution, and a capillary tube 42 positioned at lower portion of the nozzle body 40. A screw part 44 is formed on the upper circumferential surface of the nozzle body 40 for combining with the lower portion of the body 20.

The nozzle body 40 is made of engineering plastics having chemical resistance including acetal, polypropylene (PP), polyethylene (PE), polyvinylidene fluoride (PVDF), fluorine series polymer such as Teflon[polytetrafluoroethylene; PTFE], polyetheretherketon (PEEK), or polyamide series polymer such as nylon. Alternatively, the nozzle body 40 may be made of corrosion resistance metal such as stainless steel (SUS).

It is preferable that the nozzle body 40 is made so that its inner wall grows narrower downward with a streamlined gentle slope for smooth flow of the solution. It is desirable that the capillary tube 42 adopts a metal tube having an inner diameter of 0.05 to 2 mm, an outer diameter of 0.1 to 4 mm, and a length of 0.5 to 50 mm. These dimensions of the capillary tube 42 are determined on the consideration of a thickness of the spun filament and an intensity of the tube. More preferably, the capillary tube 42 has a length of 10 to 40 mm. On the other hand, a lower end of the capillary tube 42 is preferably rounded for clear discharge of the solution.

The spinning nozzle 122 shown in FIG. 5 shows that the needle-type capillary tube 42 is fit by pressure into the lower portion of the nozzle body 40. However, a spinning nozzle 122*a* according to another modification shows that a nozzle body 40*a* and a capillary tube 42*a* are integrally made as shown in FIG. 6, FIGS. 7 to 9 depict other embodiments of a spinning nozzle pack.

Figure 7:
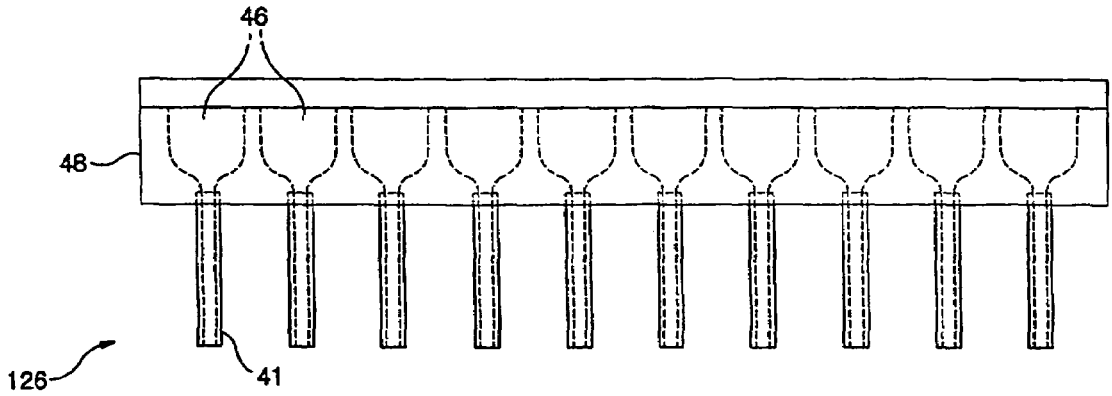
FIG. 7 through FIG. 9 show spinning nozzle packs according to several embodiments of the present invention.

The spinning nozzle pack 126 shown in FIG. 7 includes a body 48 having a plurality of solution containers 46, and a plurality of capillary tubes 41 fit by pressure into the lower portion of each solution container 46. Here, it is preferable that a distance between the body 48 and the capillary tube 41 is substantially 3 to 80 mm for stable discharge of the solution.

The body 48 is preferably made of engineering plastic having chemical resistance, which includes fluorine series polymer such as Teflon [polytetrafluoroethylene; PTFE], polyetheretherketon (PEEK), acetal, or polyamide series polymer such as nylon.

It is preferable that the body 48 having the solution containers 46 is made so that its inner wall grows narrower downward with a streamlined gentle slope for smooth flow of the solution.

Figure 8:
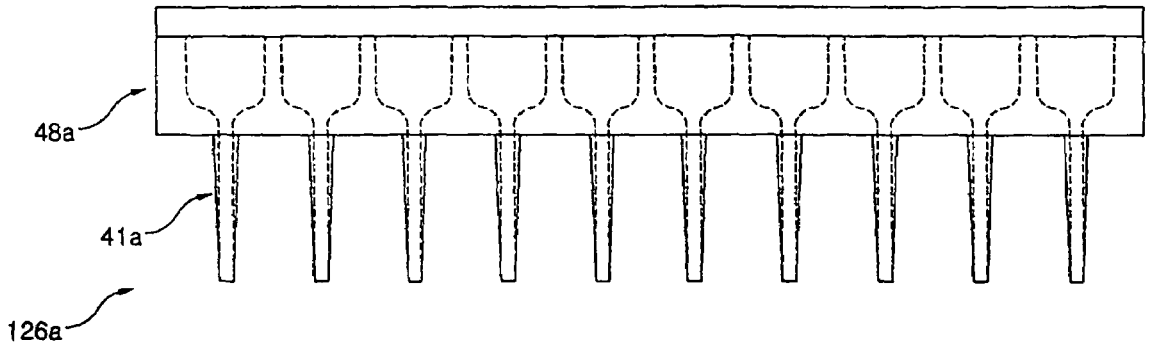

In a spinning nozzle pack 126*a* shown in FIG. 8, capillary tubes 41*a* and a body 48*a* are integrally made as a whole, and the capillary tube 41*a* has a circular cone shape so that its diameter grows narrower toward a lower end thereof. Here, the capillary tube 41*a* has a tilt angle of 3 to 60 degree to a vertical central line, and its outer circumference grows narrower toward its lower end. Thus, it is possible to prevent discharged solution from staining around tip of the capillary tube 41*a* and concentrate the electric field on the discharging direction of the filament. Preferably, the tilt angle is 5 to 45 degrees, and the distance between an end of a body frame 48*a* and the capillary tube 41*a* is 3 to 80 mm.

Figure 9:
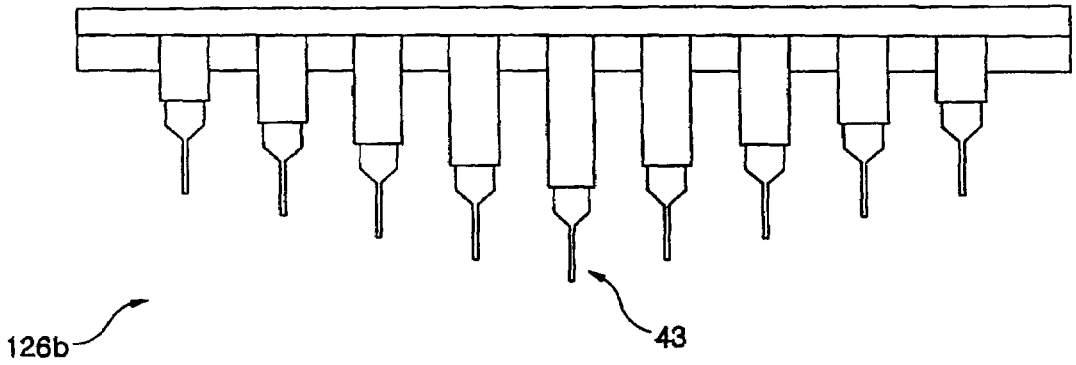

As can be seen from FIG. 9, a plurality of spinning nozzles may be arranged in the spinning nozzle pack in series so that the spinning nozzle at the center portion has the longest length and others have gradually shorter lengths toward both sides on the center of the spinning nozzle located at the center portion.

In the same way, a spinning unit 126*b* according to another embodiment of the present invention may be configured so that the spinning nozzle packs 43 have gradually shorter lengths toward both ends on the center of the spinning nozzle pack 43 located at the center portion.

Referring to FIGS. 1 and 2 again, in an apparatus 100 for producing nanofiber utilizing electrospinning according to a preferred embodiment of the present invention, the collector 130 may be grounded in order to have electric potential difference with the voltage applied to the spinning unit 120 or applied in a negative (−) voltage.

The collector 130 is used for the purpose of piling a charged filament discharged from the spinning unit 120. For example, the collector 130 can be moved continuously by means of a conveyor belt manner using a transfer means such as rollers 132.

On the other hand, considering that the voltage of the electric connector 30 for charging the spun polymer filament is about 10 to 120 kV, it is preferable that a distance between the lower end of the spinning nozzle 122 and the collector 130 is 10 to 100 cm. This distance is useful for forming an appropriate electric field for stretching a filament.

The collector 130 is made of a metal board having high conductibility, or made of various kinds of conductibility materials.

Figure 10:
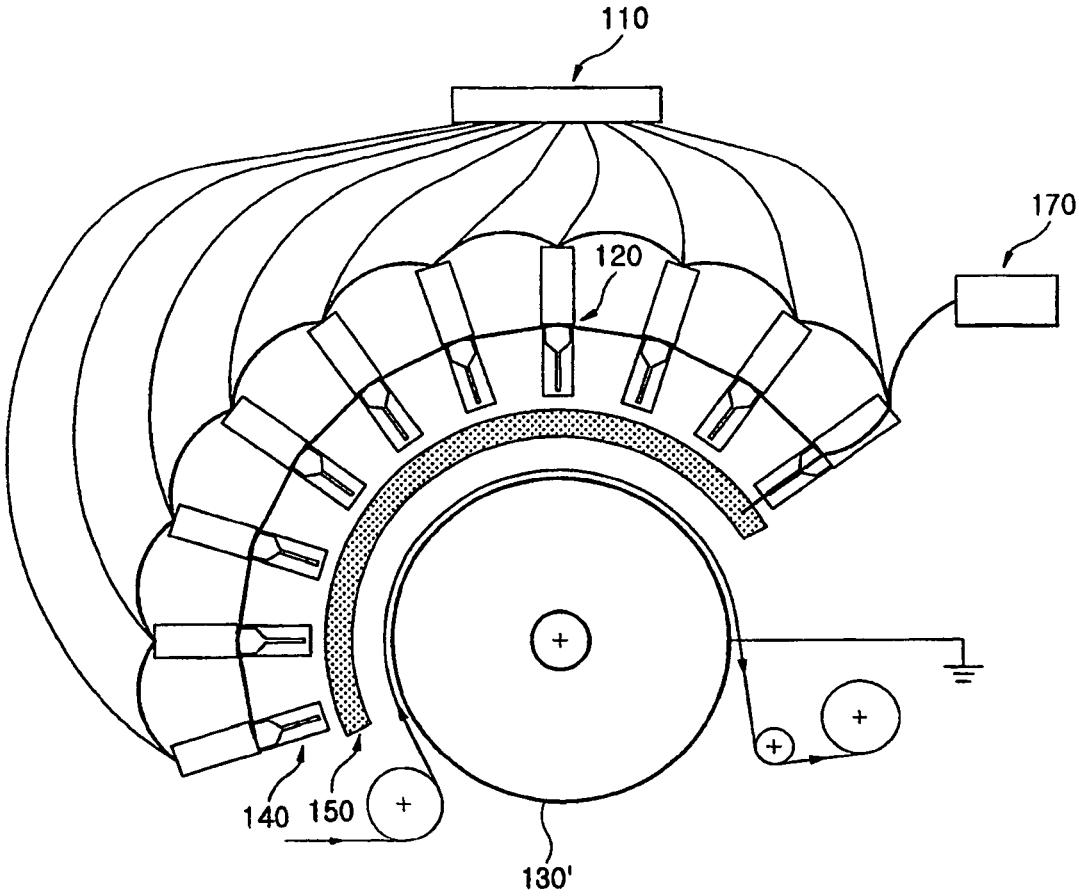
FIG. 10 is a schematic view showing an apparatus for producing nanofibers according to another preferred embodiment of the present invention.

FIG. 10 is a schematic view showing an apparatus for producing nanofiber according to another embodiment of the present invention. The component having the same reference number as FIGS. 1 and 2 is identical to the corresponding component of FIGS. 1 and 2, which has substantially the same function.

Referring to FIG. 10, a collector 130' is made in a shape of a rotating drum, differently to the embodiment shown in FIG. 1. The rotating drum 130' has a diameter of 20 to 300 cm, more preferably 30 to 200 cm, and a rotating speed of 5 to 50 rpm in order to make a charged filament be piled stably.

On the other hand, though the charged filament (P) may be directly piled on the surface of the collector 130 (see FIG. 2), the charged filament (P) is preferably coated on the surface of the piling material 182 transferred by virtue of a carrier unit 180 such as rollers above the collector 130 or 130'. The piling material 182 is nonmetallic material such as textile, nonwoven fabric, film, paper, glassing paper, thin plastic sheet and glass board. The distance between the piling material 182 and collector 130 or 130' is substantially in the range of 1 to 100 mm.

Referring now to FIG. 1 and FIG. 2, the control unit 140 is used for the purpose of preventing the filament stream (S) spun from each spinning nozzle 122 from deviating its proper route due to such as repulsion and dispersion, and voltage of same polarity as the charged filament is applied to the control unit 140. The applied voltage source to be supplied uses the output of the high voltage unit 170. However, it is also possible to add a separate high voltage supply unit.

The control units 140 are preferably installed at least at both longitudinal sides of the spinning nozzle pack 126. The control unit 140 is made in a shape of a conductor board or conductor stick, and controls so that the charged filaments become repulsive and deviate from its route due to the same polarity.

In addition, the control unit 140 may also be installed both before the most front portion and behind the most rear portion of the spinning nozzle pack 126.

The control unit 140 may be made of acrylic board or fluorine series polymer such as Teflon[polytetrafluoro ethylene; (PTFE)] capable of inducing electric charge (i.e. electric charge of same polarity as charged filament) without voltage supply, instead of the conduction board or conduction stick.

Considering direction and strength of the electrostatic force between the control unit 140 and charged filament (P), the control unit 140 is preferably installed near both ends of the spinning nozzle in the range of 1 to 20 cm from the spinning nozzle pack 126, and its lower end is preferably set within the range of about 10 cm upward to about 20 cm downward from the lower end of the spinning nozzle 122.

More preferably, the lower position of the control unit 140 is located substantially identical to the height of the lower end of the spinning nozzle 122, or set within the range of about 2 cm upward to about 7 cm downward from the end of the spinning nozzle 122.

Voltages of the same polarity as the control unit 140 are applied to the induction unit 150 shown in FIG. 1 and FIG. 2. The induction unit 150 is installed around the stretched charged filament stream (S) for guiding flow direction of the stream. The induction unit 150 is made in a shape of a conduction board or a conduction stick. The induction unit 150 is charged with the same polarity as the charged filament, thereby inducing the filament to be piled in a restricted area of the upper surface of the collector 130. The induction unit 150 is preferably made of acrylic board or fluorine series polymer such as Teflon[polytetrafluro ethylene; PTFE].

A power source equipment to supply the induction unit 150 with voltage may adopt the high voltage unit 170 described above, or a separate high voltage supply unit may be additionally used.

The induction unit 150 is arranged to be spaced from the charged filament stream discharged to the collector 130 as much as 1 to 20 cm. In addition, the induction unit 140 is positioned within the range of 1 cm lower than the spinning nozzle pack 126 and 1 cm upper than the collector 130 so as to effectively induce the filament stream to the collector 130.

Figure 11:
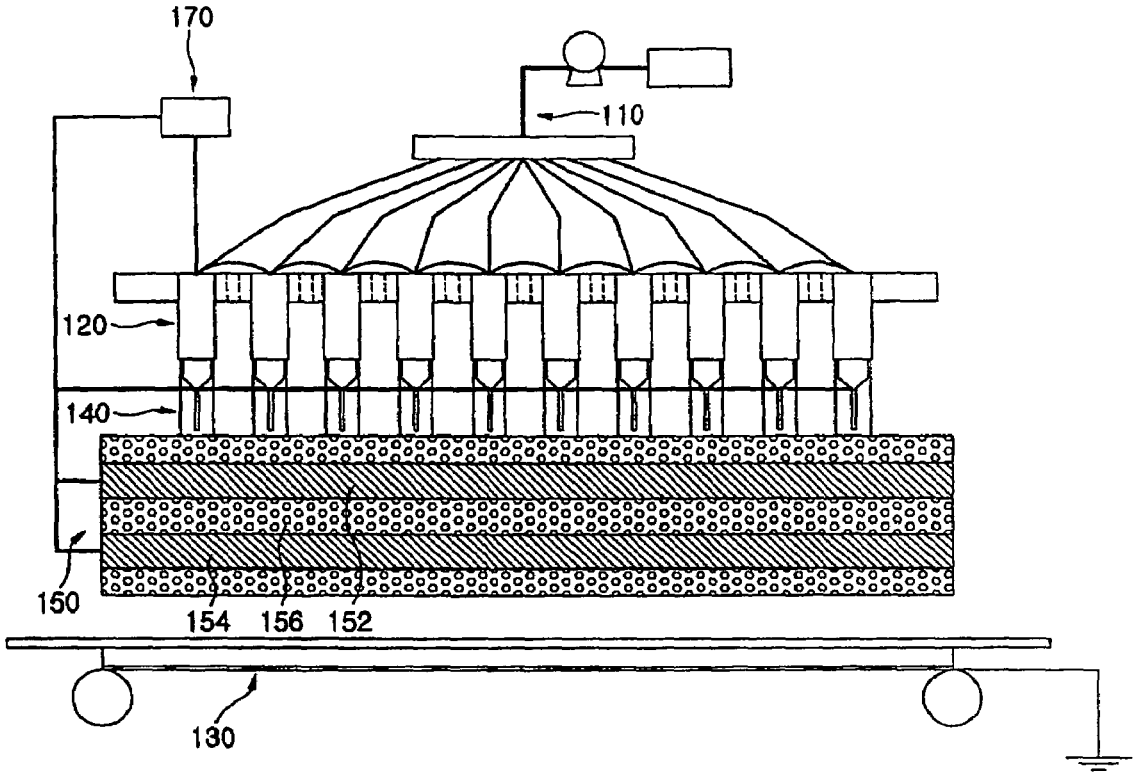
FIG. 11 is a schematic view showing an apparatus for producing nanofibers according to still another preferred embodiment of the present invention.

On the other hand, the height of the induction unit 150 is substantially in the range of 5 to 800 mm. The upper end of the induction unit 150 is positioned in the range of 1 to 90 cm downward from the lower end of the spinning nozzle 122, and in the range of 1 to 90 upward from upper surface of the collector 130. The induction unit 150 may be composed of a pair of conduction boards as shown in FIG. 1. In other case, the induction unit 150 may also be composed of two pairs of induction boards 152 and 154 separated in two part as shown in FIG. 11. A porous plate 156 for ensuring a space for solvent volatilization is preferably positioned between these induction boards 152 and 154, so it is possible to induce the stream into the piling area through two steps.

As shown in FIGS. 1 and 2, the air conditioning unit 160 is used for volatilizing and exhausting the solvent dissolved in the charged filament in the space between the spinning unit 120 and the collector 130, and includes solvent inspiration/exhaust means such as an inhalation fan and an exhaust fan, and a plurality of air inflow slots 162.

The solvent inspiration/exhaust means may adopt various known blowers. For example, the inhalation fan is installed in the air inspiration path, inhales dry air from outside of the apparatus, and then injects the dry air into the space between the spinning unit 120 and the collector 130 through the air inflow slot 162 positioned at the upper portion of the spinning nozzle pack 126. The inhaled air volatilizes the solvent dissolved in the charged filament (P) spun by the spinning nozzle 122, and then exhausted outside through an air exhaust path to which the exhaust fan is installed.

The apparatus for producing nanofibers according to the present invention is not limited to this air circulation structure, but the inspiration or exhaust direction of the air including solvent may be changed as desired.

Considering volatility of the solvent or an accumulation rate of the filament, the temperature of the air injected through the solvent inspiration/exhaust means (for example, the blast fan) is substantially set within the range of 5 to 80° C. In addition, it is also desirable that an air velocity in the solvent exhaust path is preferably set within the range of 0.1 to 10 m/s in order not to affect the discharged stream.

Hereinafter, operations of the apparatus for producing nanofibers utilizing electrospinning according to a preferred embodiment of the present invention will be described.

First, if fiber-forming solution stored in the supply unit 110 is constantly supplied to the spinning unit 120 through a pump 114 and a distributor 116, the solution is charged by the electric connector 30 of each spinning nozzle pack 126 of the spinning unit 120. Here, the electric connector 30 is installed to be received in the body 20 of the spinning nozzle pack 126 in order to prevent direct electrical mutual action with the collector 130.

Next, the charged solution is discharged in a shape of fine filament toward the collector 130 after passing through the capillary tube 42 of the spinning nozzle 122. Here, the filament of nanometer diameters is stretched and spun by strong electric field formed between the collector 130 and the charged filament to have a diameter of several nanometers.

In this spinning process, the control unit 140 controls the filament stream, which tends to deviate from its route and be dispersed outward, so that the stream returns to its correct position and maintains a correct path.

On the other hand, since the induction unit 150 is installed above the collector 130 to surround the discharged stream, the stream tending to be leaked out of the path is induced into the restricted piling area.

Filaments induced as described above are continuously piled on the conveyor belt or the collector 130 having a shape of a rotating drum or piled on the upper surface of the piling material 182, and then manufactured into a web composed of nanofibers.

INDUSTRIAL APPLICABILITY

The apparatus for producing nanofibers according to the present invention gives the following effects.

First, the apparatus can stably produce a great amount of nanofibers without filament stream deviating from a correct path by means of the control unit and/or the induction unit located at both ends of the spinning unit.

Second, in case of the spinning unit, since the electric connector for charging the fiber-forming solution is positioned within the spinning nozzle pack, it is possible to prevent discharge stream from being irregularly discharged, due to electrical mutual action between the electric connector and the collector.

Third, the apparatus can prevent discharge stream from piling in a condensed state by adopting the air conditioning system for exhausting solvent from a great amount of discharge stream.

The apparatus for producing nanofibers according to the present invention can produce nanofibers having a diameter of 100 to 5000 nm by using the electrospinning techniques, and a web having a thickness of 10 to 3000 μm may be manufactured by piling the nanofibers on the collector.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. An apparatus for producing nanofiber utilizing electrospinning comprising:

a supply unit for supplying polymer materials of the liquid state used to produce fibers;

a spinning unit having at least one spinning nozzle pack in which a plurality of spinning nozzles for discharging the polymer materials supplied by the supply unit in a charged filament form are arranged in series;

a collector installed below the spinning unit for piling the charged filament discharged by the spinning unit in a specific thickness;

a control unit charged to have a voltage of same polarity as one of the charged filament and positioned at both longitudinal sides of the spinning nozzle pack for guiding the stream of the charged filament in order to prevent repulsion and dispersion of the charged filaments discharged from spinning nozzles installed at both ends of the spinning nozzle pack;

an induction unit positioned between the control unit and the collector to surround the filament stream for inducing the charged filament stream passing through the control unit toward the collector, a voltage of same polarity and same value as the control unit being applied to the induction unit; and a carrier unit for carrying a pilling material to which the charged filament is to be adhered and which is positioned above the collector.

2. The apparatus according to claim 1, further comprising a transfer mount for reciprocating the spinning unit at a predetermined speed.

3. The apparatus according to claim 2, further comprising an air conditioning unit for inhaling air into an air layer between the spinning unit and the collector and discharging a solvent from the air layer to outside.

4. The apparatus according to claim 3, wherein the spinning unit includes at least one spinning nozzle pack in which the spinning nozzles are arranged in series.

5. The apparatus according to claim 4, wherein each spinning nozzle pack is configured so that the spinning nozzles have gradually shorter length outward from the spinning nozzle located at a center portion.

6. The apparatus according to claim 1, wherein the control unit is spaced apart from the adjacent spinning nozzle as much as about 1 to about 20 cm.

7. The apparatus according to claim 1, wherein the collector includes a conveyor belt rotating at a speed of about 0.1 to 30 m/min.

8. The apparatus according to claim 1, wherein the collector includes a rotating drum rotating at a speed of about 5 to 50 rpm.

9. A spinning nozzle pack for forming a polymer web by electrostatically spinning a solution used as fiber-forming material, comprising:

a body having a supplier for supplying the solution and a receiver for receiving the supplied solution;

an electric connector mounted on the body to be sunk in the solution for charging the solution when voltage is supplied thereto; and a plurality of spinning nozzles, each having a capillary tube for discharging the solution charged by the electric connector in a fine filament form, wherein the electric connector is made in a shape of a conductor board or a conductor stick of a predetermined length and has valleys and ridges periodically formed along a longitudinal direction thereof; and wherein the ridges are fit on the center of the spinning nozzles.

10. The spinning nozzle pack according claim 9, wherein the spinning nozzles are configured so that lengths of the capillary tubes are gradually short toward both sides in the longitudinal direction of the spinning nozzle pack from the spinning nozzle located at a center portion.

11. The spinning nozzle pack according claim 9 or 10, wherein the body is made of engineering plastic belonging to polyetheretherketon, fluorine series or polyamide series.

12. The spinning nozzle pack according claim 9 or 10, further comprising: a filter installed in the receiving part for removing gelation particles and waste materials in the charged solution.

13. The spinning nozzle pack according claim 12, further comprising:

a distribution board installed in the receiving part for regularly distributing the charged solution passing through the filter toward each spinning nozzle.

14. The spinning nozzle pack according claim 9 or claim 10, wherein the spinning nozzle can be combined in an orifice of the body selectively.

15. The spinning nozzle pack according claim 9 or 10, wherein the spinning nozzle is made of one selected from the group consisting of polypropylene, polyethylene, polyvinylidenefluoride, polytetrafluoroethylene series and polyetheretherketon, polyamide series, or corrosion resistance metal.

16. The spinning nozzle pack according claim 9 or 10, wherein the capillary tube is integrally formed with the body.

17. The spinning nozzle pack according claim 16, wherein the capillary tube has a tilt angle of substantially 3 to 60 degrees to a vertical central line so as to have a shape of a circular cone in which a diameter grows narrower toward a lower end thereof.

18. The spinning nozzle pack according claim 9 or 10, wherein each capillary tube substantially has an inner diameter of 0.05 to 2 mm, an outer diameter of 0.1 to 4 mm, and a length of 0.5 to 50 mm.

19. The spinning nozzle pack according claim 9, wherein the body is capable of sealing up the receiving part, and includes a cover in which the supply unit is provided.

* * * * *